United States Patent [19]

Wierschke

[11] 4,445,995

[45] May 1, 1984

[54] CATHODE HEAD HAVING IMPROVED SEAL MEANS

[75] Inventor: Donald J. Wierschke, Brownsburg, Ind.

[73] Assignee: RCA Corporation, New York, N.Y.

[21] Appl. No.: 470,560

[22] Filed: Feb. 28, 1983

[51] Int. Cl.[3] ..... C25D 1/10; C25B 17/08

[52] U.S. Cl. ..... 204/281; 204/5; 204/297 R; 204/297 W

[58] Field of Search ..... 204/5, 224 R, 279, 281, 204/297 R, 297 W, DIG. 7

[56] References Cited

U.S. PATENT DOCUMENTS

| | | | |
|---|---|---|---|
| 2,018,471 | 10/1935 | Russell | 204/5 |
| 2,675,348 | 4/1954 | Greenspan | 204/297 W |
| 2,890,160 | 6/1959 | Hunting et al. | 204/281 |
| 3,414,502 | 12/1968 | Porrata et al. | 204/15 |
| 4,259,166 | 3/1981 | Whitehurst | 204/279 |
| 4,341,613 | 6/1982 | Prusak et al. | 204/281 |
| 4,364,816 | 12/1982 | Birt | 204/297 W |
| 4,385,978 | 5/1983 | Prusak | 204/281 |

*Primary Examiner*—Howard S. Williams
*Assistant Examiner*—T. Williams
*Attorney, Agent, or Firm*—Birgit E. Morris; Edward J. Sites

[57] ABSTRACT

An improved cathode head is provided for use in the matrixing of masters, molds and stampers for use in the manufacture of molded records and discs. The cathode head of this invention has a disc shaped member on which a matrix to be replicated is to be mounted and an outer threaded ring which is screwed on the outer edge of the disc member to secure the outer edge of a matrix to be replicated to the surface of the disc shaped member. It has been found in accordance with this invention that the seal formed at the outer edge between the ring member, the matrix replicated and the disc shaped member can be substantially improved as compared to that of a prior art cathode head by using a seal having a right triangular shaped lead section which, in addition to providing a substantially improved electrolyte seal disc, allows the replica to be formed having a perpendicular outer edge.

6 Claims, 7 Drawing Figures

CATHODE HEAD HAVING IMPROVED SEAL MEANS

This invention relates to a cathode head having an improved electrolyte seal for use in electroforming masters, mothers and stampers.

BACKGROUND OF THE INVENTION

In the conventional method employed for the manufacture of molded records such as audio records or the more recently developed capacitive electronic discs, the signal information to be molded into the record or disc is initially cut into a recording substrate along a spiral groove. The recorded substrate is then prepared for electroforming. The surface of wax or laquer substrates used for audio records are activated so as to accept electrodeposited metal. Metal substrates such as the copper substrates used for capacitive electronic discs are passivated so as to prevent adhesion of the electrodeposited metal to the surface of the metal substrate.

The recorded surface of the substrate is then replicated by electroforming a metal such as nickel on the recorded surface of the substrate to produce a master on the surface of the recorded substrate. The recorded surface of the resulting metal master is then passivated and in turn is replicated to form a series of mothers. The recorded surface of the resulting mothers are in turn passivated and replicated to provide a series of stampers. The resulting metal stampers are the parts used to mold the audio records or capacitive electronic discs. The above sequential process of making masters, mother and stampers is referred to as matrixing.

One of the most important pieces of equipment used in the matrixing process is the cathode head. The cathode head is the apparatus on which the part to be replicated, referred to as a matrix, is mounted during electroforming of a replica on the surface thereof. The cathode head is secured to the cathode of an electroforming apparatus and is generally rotated in the electrolyte in the electroforming apparatus during matrixing.

Various types of cathode heads have heretofore been suggested in the art for use in the matrixing process. One widely used type of cathode head had a flat disc configuration and was used in combination with a u-shaped rubber band-like outer edge seal. Using the above type of cathode head the matrix was initially secured to the cathode head at its center. A preplate of metal was then applied over the entire surface of the matrix with care being taken to insure that a thin layer of metal extended over the outer edge of the matrix. The thin layer of deposited metal was used to physically prevent the preplated metal and metal subsequently deposited on the matrix from separating from the surface of the matrix during electroforming. After the required thickness of preplated metal was applied to the surface of the matrix the preplating was discontinued and the U-shaped rubber ring was placed about the outer edge of the matrix so as to form a seal over the outer edge to prevent further plating of the edge portion. The electroforming was then continued until a replica with the desired thickness was obtained. The apparatus and the procedure described above did not prove to be completely satisfactory in practice. The discontinuation of the plating process in order to install the rubber edge shield on the matrix results in a substantial reduction in the quality of the plating. A further significant problem encountered was that the plating of metal over the edges of the matrix results in considerable difficulty being encountered when separating the replica from the matrix with the resulting replicas having rough irregular outer edges.

Cathode heads have also been suggested which had rubber backs and integral edge seals to secure the matrix to the cathode head during electroforming. A cathode head of this type is disclosed by L. R. Porrata et al. in U.S. Pat. No. 3,414,502 issued Dec. 3, 1968 entitled "Electroplating Apparatus for Use With Phonograph Record Matrix." Apparatus such as disclosed by Porrata et al. was found to be unsatisfactory in practice in that it was difficult to physically insert a matrix into the cathode head. Furthermore, the rubber edge shield could not be tightly secured to the matrix and this allows leakage of electrolyte about the edges of the matrix to the back side of the matrix, causing undesirable edge and back plating.

Another type of cathode head which has heretofore been suggested in the prior art to improve the quality of the matrixing of masters, molds, and stampers is disclosed by Whitehurst in U.S. Pat. No. 4,259,166 entitled "Shield For Plating Substrates." The device disclosed by Whitehurst provides a masking apparatus which has certain distinct advantages over the cathode heads heretofore mentioned but still had the disadvantage that it was difficult to assemble and problems were still encountered in separating electroformed replicas from the matrixes.

A significantly improved type of cathode head was disclosed by Prusak et al. in U.S. Pat. No. 4,341,613 issued July 22, 1982 entitled "Apparatus for Electroforming." The Prusak et al. cathode has a flat disc shape support which is threaded on its outer edge. A matrix to be replicated is secured at the center thereof to the cathode with a cathode knob. A threaded outer ring is provided which includes a flat seal designed to engage the outer edge of the matrix to prevent electrolyte from leaking past the seal to the outer edge of the matrix. The threaded outer ring is screwed onto the threaded outer edge of the flat disc shape member and should be tightened until an electrolyte tight seal is obtained. In practice the Prusak et al. cathode head has proven to be highly successful in almost all respects. Problems have, however, been encountered in forming an electrolyte tight seal at the outer edge of the matrix.

What would be highly advantageous would be a cathode head having the advantageous features of the Prusak et al. apparatus but which would further include means for providing an improved electrolyte seal so as to prevent leakage of electrolyte to the outer edges of the matrix during electroforming.

SUMMARY OF THE INVENTION

An improved cathode head is provided for use in the matrixing of masters, molds and stampers for use in the manufacture of molded records and discs. The cathode head of this invention has a disc shaped member on which a matrix to be replicated is to be mounted and an outer threaded ring which is screwed on the outer edge of the disc member to secure the outer edge of a matrix to be replicated to the surface of the disc shaped member. It has been found in accordance with this invention that the seal formed at the outer edge between the ring member, the matrix replicated and the disc shaped member can be substantially improved as compared to that of the Prusak et al. cathode head by using a seal having a right triangular shaped lead section which, in addition to providing a substantially improved electrolyte seal disc, allows the replica to be formed having a perpendicular outer edge.

DETAILED DESCRIPTION OF THE INVENTION

Figure 1:
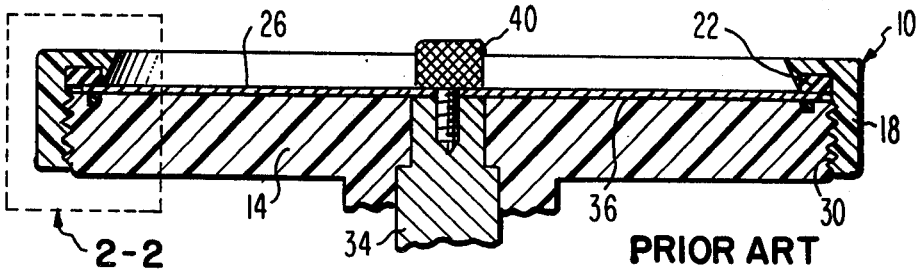
FIG. 1 is a cross-sectional illustration of a cathode head of the prior art.
Figure 2:
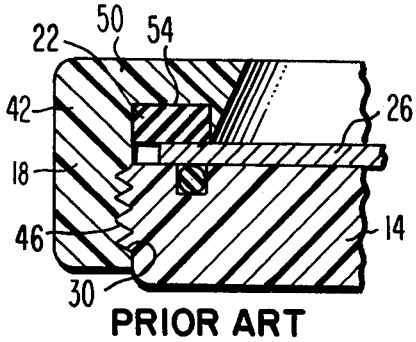
FIG. 2 is an enlargement of the edge portion of the prior art cathode head of FIG. 1 taken as indicated by the line and arrow 2—2 on FIG. 1.
Figure 4:
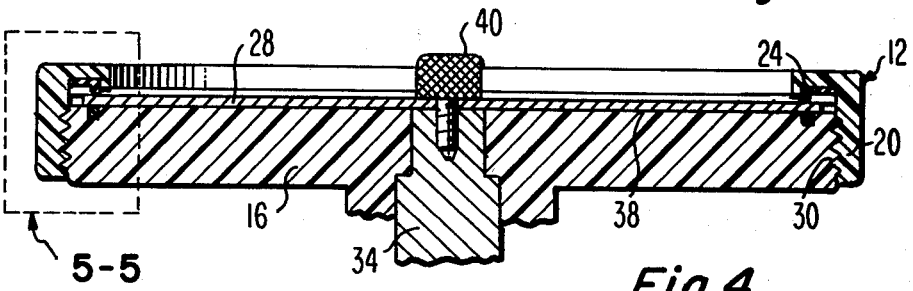
FIG. 4 is a cross-sectional illustration of a cathode head of the present invention.
Figure 5:
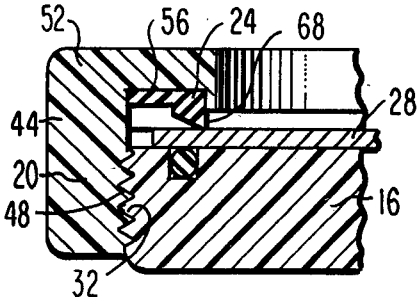
FIG. 5 is an enlarged cross-sectional illustration of an edge portion of the cathode head of the present invention taken as indicated by the lines and arrow 5—5 on FIG. 4.
Figure 7:
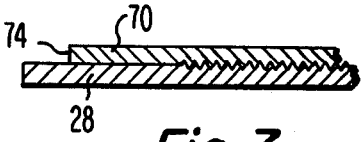
FIG. 7 is a cross-sectional illustration of an edge portion of a matrix and a replica obtained using the cathode head of this invention as illustrated in FIG. 4.

The prior art cathode head 10 which is illustrated in FIGS. 1 and 2 is substantially identical to the cathode head disclosed in Prusak et al. U.S. Pat. No. 4,341,613. The prior cathode head 10 is likewise similar in many respects to the cathode head of the present invention 12 which is illustrated in FIGS. 4 and 5. Because of the many similarities between the prior art cathode head 10, the Prusak et al. cathode head, and the cathode head of the present invention 12, the disclosure of Prusak et al. U.S. Pat. No. 4,341,613 is hereby incorporated by reference with regard to the specific details of the elements which are common to the illustrated prior art cathode head 10, the Prusak et al. cathode head and the cathode head of this invention 12.

The cathode head of the prior art 10 and the cathode head of the present invention 12 are each comprised of a disc shaped members 14, 16, a ring member 18, 20 and a circumferential seal 22, 24.

The disc shaped members 14, 16 have an outer diameter which is at least as large as the matrix 26, 28 which, as shown, are mounted on the disc shaped members 14, 16. At the outer diameter of the disc shaped members 14, 16 there is defined male threads 30, 32. The disc shaped members 14, 16 are secured to a cathode 34 by screws or other attachment means (not shown). The matrixes 26, 28 to be replicated as illustrated are positioned on the flat face surface 36, 38 of the disc shaped members 14, 16 held in place at the centers thereof by a cathode knob 40.

The ring member 18 of the prior art cathode head 10 and the ring member 20 of the cathode head of the present invention 12 are similar in construction. Each ring member 18, 20 is an integral structure having an outer cylindrical ring portion 42, 44 which has a female thread 46, 48 defined on the interior thereof which threadably mates with the male threads 30, 32 on the disc shaped members 14, 16. The ring members 18, 20 also have radially inwardly extending portions 50, 52 which have defined therein a grooves 54, 56 for receiving and holding a seal in a circumferential position with respect to the disc shaped members 14, 16.

Figure 3:
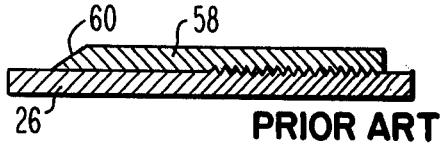
FIG. 3 is a cross-sectional illustration of an edge portion of a matrix and a replica obtained using the cathode head of the prior art illustrated in FIG. 1.

Referring to the seal of the prior art cathode head 22 as best seen in FIG. 2, and to the seal 24 used in the cathode head of the present invention 12 as best seen in FIG. 5, it can be seen that the seal 22 used in the cathode head of the prior art 10 and the seal 24 of the cathode head of the present invention 12 are different in kind with regard to their cross-sectional configuration. The cathode seal 22 used in the prior art cathode head 10 has a substantially rectangular configuration and is positioned so as to have the elongated flat portion of the seal make substantial area contact with a matrix 26 held in position on the cathode head of the prior art 10. Using the seal 22 of the prior art cathode head 10 the replica 58 which is formed on the matrix 26 has a feathered edge 60 as illustrated in FIG. 3. The feathered edge 60 is not desirable in the matrixing process in that it presents difficulties when it is attempted to separate the replica 58 from the surface of the matrix 26 and furthermore the feathered edge 60 must be trimmed from the replica by future processing steps. The prior art seal 22 also causes problems when tightening the ring member 18 onto the disc 14 because the large surface area of contact of the seal 22 with the matrix 26 requires excessive force per square unit of area contact to make the electrolyte tight seal required for satisfactory matrixing of replicas using the cathode head 10.

Figure 6:
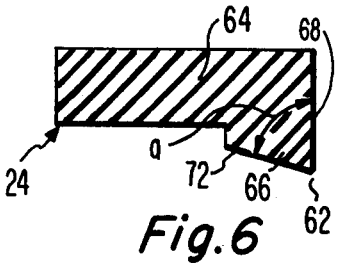
FIG. 6 is a cross-sectional illustration of the seal of the present invention.

Turning now to FIGS. 4, 5 and 6 it can be seen that the seal 24 of the cathode head of the present invention 12 has a right triangular shaped leading edge 62 which effectively presents effectively a knife edge shaped portion to engage the matrix 28. More particularly as can be best seen in FIG. 6, the seal 24 has first and second integral portions 64, 66. The first portion 64 of the seal 24 is shaped so as to be received and held by the circumferential groove 56 in the outer ring member 20 of the cathode head 12. The second portion 66 extends downwardly from the first portion 64 towards the surface of the disc shaped member 16 when the ring member 20 is engaged with the threads of the disc shaped member. The second portion 66 is of a generally right triangular configuration. One of the leg sides 68 of the triangular portion 66 is positioned so as to be substantially perpendicular to the flat face 38 of the disc shaped member 16. The groove 56 in the ring member 20 is cut so that the leg side 68 of the seal 24 will form a circumferential, substantially vertical wall of the desired second smaller diameter of the replica 70 to be formed on the matrix 28 when held by the cathode head 12. The leg side 68 of the triangular portion of the seal 24 extends downward to the leading edge 62 where it forms an apex with the hypotenuse side 72 of the triangular portion 66. The angle, a, formed by the leg side 68 and the hypotenuse side 72 at the apex can vary over a relatively wide range. However, it has been found that the optimum results are obtained when the angle is approximately about 75°. With this particular angle, the triangular portion has sufficient rigidity so as to not to deform excessively during tightening of the ring member 20 toward the matrix 28 and thereby maintain a substantially perpendicular wall against which to electroform the replica 70 while still maintaining an electrolyte tight seal.

The seal 24 employed in the present invention can be made of various materials. The materials which are used should be passive so as not to accept plating of metal onto the seal and in addition should be resistant to the electrolyte and other conditions encountered in the electroforming operation. The most preferable material from which to form the seal 24 has been found to be silicone rubber. The relative hardness of the material used to make the seal is an additional important variable, with hardnesses between about 25 and 40 durometer appearing to be most suitable, with about a 30 durometer material being most preferred.

In use, the cathode head of this invention 12 is employed similarly to the prior art cathode heads of the type illustrated in FIGS. 1 and 2. One very noticeable change, however, is encountered with regard to the tightening of the ring member 20 to the disc member 10. Substantially less force is required in order to obtain a superior seal of the ring member 20 to the matrix 28 to be replicated and consistently better sealing results are obtained because of the increase in the force applied per square unit area as a result of having a knife edge seal as opposed to the flat surface of the prior art seal. A further advantage which is obtained using the cathode head 12 of this invention, is that the replica 70 electroformed on the cathode head of this invention 12 will have a square edge 74 as a result of being formed against the perpendicular leg side 68 of the triangular portion 66 of the seal 24. An additional further advantage of the cathode head of this invention 12, is that significantly less damage occurs to the seal 24 during use so that the seal can be used for extended production runs without being replaced. The extended life of the seal 24 is due in part to the superior contact made by the seal 24 to the matrix so that no electroformed metal forms under the seal 24 which will damage the seal 24 as the cathode head 12 is disassembled to remove the replica 70 and matrix 28 from the head 12 after electroforming. In actual practice, the cathode head 12 of this invention has been found to give superior results as compared to all of the prior art type cathode heads noted above and does not exhibit any of the disadvantages heretofore noted with regard to the prior art devices.

What is claimed is:

1. In a cathode head for holding a flat circular matrix of a first diameter during electroforming of a replica of a second, smaller diameter on the surface of the matrix, wherein said cathode head is comprised of:

(a) a disc shaped member having an outer diameter at least as large as the first diameter, a flat face for holding said matrix to be replicated and a male thread defined on the outer edge thereof;

(b) a ring member having an integral outer cylindrical portion and a radially inwardly extending portion, said outer cylindrical portion having a female thread which mates with the male threads of the disc shaped member and the radially inwardly extending portion including seal holding means; and (c) a circumferential seal positioned in said seal holding means whereby when the ring member is threadably engaged with the outer edge of the disc member and screwed towards the disc member, the circumferential seal engages the outer flat surface of said matrix held on the flat face of the disc shaped member; said improvement comprising: using a circumferential seal having a cross-sectional configuration comprised of integral first and second portions, said first portion being of a shape so as to be held by the seal holding means of the ring member and said second portion being of a substantially right triangular configuration and extending downward from the first portion with a leg side of the triangular portion forming a substantially perpendicular cicumferential wall with respect to the flat surface of said matrix thereby defining an electroforming area of said second diameter, said leg side of the triangular portion extending to an apex where it meets the hypotenuse side of the triangular portion which hypotenuse side then extends upwardly towards the outer edge of the first portion of the seal; whereby the edge formed at the apex of the triangular portion provides an improved electrolyte tight engagement of the seal to said matrix to be replicated and the leg side of the right triangular portion of the seal provides a substantially perpendicular wall against which said replica having a perpendicular edge can be electroformed.

2. The cathode head according to claim 1 wherein the angle formed by the leg side of the triangular portion of the seal with the hypotenuse side of the triangular portion of the seal is about 75°.

3. The cathode head according to claim 1 wherein the seal is made of an electrolyte resistant, passive material.

4. The cathode head according to claim 1 wherein the seal is made of silicone rubber.

5. The cathode head according to claim 1 wherein the seal is made of a material having a hardness about 25 to 40 durometer.

6. The cathode head according to claim 1 wherein the seal is made of a material having a hardness of about 30 durometer.

* * * * *